United States Patent [19]

Nakakoji et al.

[11] Patent Number: 5,021,301

[45] Date of Patent: Jun. 4, 1991

[54] METHOD OF PRODUCING A STEEL SHEET PLATED WITH ZN-MG ALLOY SUPERIOR BOTH IN PLATING ADHESION AND CORROSION RESISTANCE, AND STEEL SHEET PLATED WITH THE SAME

[75] Inventors: Hisatada Nakakoji; Seiji Nakajima; Akira Yasuda; Hajime Kumura, all of Chiba, Japan

[73] Assignee: Kawasaki Steel Corporation, Hyogo, Japan

[21] Appl. No.: 600,523

[22] Filed: Oct. 19, 1990

[30] Foreign Application Priority Data

Oct. 23, 1989 [JP] Japan ..... 1-273863

[51] Int. Cl.[5] ..... C25D 3/66; C25D 7/06

[52] U.S. Cl. ..... 428/659; 204/27; 204/38.1; 204/39

[58] Field of Search ..... 204/27, 38.1, 39; 428/658, 659

[56] References Cited

U.S. PATENT DOCUMENTS 4,904,544 2/1990 Mori ..... 204/44.2

*Primary Examiner*—T. M. Tufariello

*Attorney, Agent, or Firm*—Austin R. Miller

[57] ABSTRACT

A plated steel sheet is produced by an electroplating in a plating bath of about 350° to 500° C. containing a chloride of Zn, a chloride of Mg and one, two or more of chlorides of Na, K and Li, with a plating current density ranging between about 20 and 350 A/dm$^2$.

The Zn-Mg alloy plated steel sheet superior both in plating adhesion and corrosion resistance has a plating layer formed on at least one surface thereof in an amount of about 10 to 60 g/m$^2$, and by electroplating in a bath of a fused salts, the plating layer containing about 1 to 35 wt % of Mg, about 0.5 to 25 wt % of mean value of Fe and the balance substantially Zn and incidental inclusions. The Fe content in the plating layer has such a gradient that its concentration is greatest at the interface between the plating layer and the steel sheet and progressively decreases towards the surface of the plating layer opposite to the steel sheet where the Fe content is substantially zero. The plated steel sheet may further have a chromate treatment layer formed on the plating layer, with or without an organic coating film formed on the chromate treatment layer.

7 Claims, No Drawings

METHOD OF PRODUCING A STEEL SHEET PLATED WITH ZN-MG ALLOY SUPERIOR BOTH IN PLATING ADHESION AND CORROSION RESISTANCE, AND STEEL SHEET PLATED WITH THE SAME

BACKGROUND OF THE INVENTION

1. Field of the Invention

The present invention relates to a method of producing a steel sheet plated with a Zn-Mg alloy. The invention also is concerned with such a steel sheet, which is superior both in plating adhesion and corrosion resistance and which is suitable for use in automobiles, household electric appliances, architecture and so forth.

2. Description of the Related Art

Hitherto, steel sheets have been widely used in automobiles, household electric appliances, architecture and so forth. Conventional steel sheets tend to become rusty under normal use. To avoid this problem, plated steel sheets are finding widespread use. Typically, Zn plating of steel sheets has been adopted for a long time. In recent years, however, various Zn type plating alloys have been developed and used to cope with the demand for enhancement of anti-rust performance of steel sheets.

Zn-alloy plating is broadly sorted into two types: namely, hot-dip plating with Zn-Fe alloy or Zn-Alλ alloy, and electroplating with Zn-Ni alloy or Zn-Fe alloy. These plating methods are selected according to the uses but do not provide satisfactory rust prevention. On the other hand, there is a trend for diversified demands of users. In order to meet such demands while attaining sufficient rust prevention, various attempts and studies are being conducted to develop novel plating techniques.

Plating with an alloy formed by adding Mg to Zn, as one of such attempts, is now calling for attention. Mg is an element which effectively enhances the rust prevention effect inherently possessed by Zn, and various Zn-Mg alloys for plating, as well as methods of producing such alloys, have been proposed.

Hot-dip plating was considered first as a method of plating with Zn-Mg alloy, as well as a production method. Hot-dip plating techniques using Zn-Mg alloys are disclosed, for example, in Japanese Patent Laid-Open Publication Nos. 56-96036, 56-123359, 56-152953 and 56-152956. Hot-dip plating with a Zn-Mg alloy, however, suffers from the following problem. Namely, since Mg has a melting point of 650° C. much higher than that of Zn which is 419° C., Mg can be added to Zn plating bath only in a very small quantity, e.g., less than 1 wt%. In addition, the high temperature of the plating bath adversely affects the properties of the steel sheet to be plated, causing problems such as impairment of workability of the steel sheet.

Products plated with Zn-Mg alloys by physical vapor deposition are shown in Japanese Patent Laid-Open Publication Nos. 64-17851, 64-17852 and 64-17853. Physical vapor deposition, however, requires a heat source of large output power for the purpose of vaporizing Mg and Zn, which undesirably raises the cost of the production equipment. In addition, this plating method cannot provide high plating adhesion and cannot provide a fine uniform plating layer.

Electroplating with a Zn-Mg alloy also is difficult to conduct when an ordinary aqueous solution is used, due to the excessive difference in electrochemical potential between Zn and Mg. Although a plating bath containing a fluoride is disclosed in Japanese patent Laid-Open Publication No. 58-144492, this plating bath cannot contain Mg in excess of 1 wt %.

Thus, it has been impossible to obtain a steel sheet which is plated with a Zn-Mg alloy and which is superior both in plating adhesion and corrosion resistance.

OBJECTS OF THE INVENTION

Accordingly, an object of the present invention is to provide a method of producing a steel sheet plated with a Zn-Mg alloy superior both in plating adhesion and corrosion resistance.

Another object of the present invention is to provide such a steel sheet.

To these ends, according to one aspect of the present invention, there is provided a method of producing a Zn-Mg alloy plated steel sheet superior both in plating adhesion and corrosion resistance, comprising the step of electroplating at least one surface of a steel sheet by using a plating bath of a fused salt at about 350° to 500° C. and containing a chloride of Zn, a chloride of Mg and one, two or more chlorides of Na, K and Li, with a plating current density ranging between about 20 and 350 A/dm$^2$.

According to another aspect of the present invention, there is provided a Zn-Mg alloy plated steel sheet superior both in plating adhesion and corrosion resistance, comprising a plating layer formed on at least one surface thereof in an amount of about 10 to 60 g/m$^2$, the plating layer containing about 1 to 35 wt % of Mg, about 0.5 to 25 wt % of the mean value of the Fe and the balance substantially Zn and incidental inclusions.

Thus, the method of the present invention features the use of a fused salt. On the other hand, the Zn-Mg alloy plated steel steel of the present invention is characterized in that Fe is present in addition to Mg in the plating layer so as to improve the plating adhesion.

The above and other objects, features and advantages of the present invention will become clear from the following description of the preferred embodiments.

DESCRIPTION OF THE INVENTION

A Zn-Mg alloy plating layer of the present invention is preferably formed by electroplating with a fused salt plating bath.

In order that the Zn-Mg alloy plating layer produces appreciable rust prevention effect on the plated steel sheet, the Mg content in the alloy should be greater than a certain lower limit value. With this knowledge, the inventors have considered that the key to the production of Zn-Mg plated steel sheet having superior corrosion resistance is to develop a plating method which can maximize the Mg content in the plating layer. It has been found, as a result of an intense study, that this requirement is met best by electroplating with a plating bath formed of a fused salt. When an ordinary aqueous solution is used, the alloy can contain only a trace amount of Mg, partly because a large difference of potential exists between Mg and Zn and partly because the potential of Mg, is extremely basic. In contrast, when a fused salt is used as the plating bath, the amount of Mg in the plating bath can be increased in accordance with an increase in the amount of Mg ions in the bath. In addition, a plating bath formed of fused salt affords a high electric current density and, hence, a high production efficiency.

The electroplating with a fused salt bath also facilitates control of the Mg content in the plating layer. In addition, this plating method forms a thicknesswise gradient of Fe diffused from the surface of the steel sheet such that the Fe concentration progressively decreases towards the surface of the plating layer opposite to the steel sheet. Thus the plated steel sheet superior both in plating adhesion and corrosion resistance is produced by the present invention.

A mixture of fluoride or nitrate can be used as the fused salt bath. The inventors have found, however, that a bath of a chloride can be used most suitably because such a bath enables the plating to be conducted at a comparatively low temperature and because it has a small tendency toward explosion and corrosion. The fused salt bath used in the present invention contains one, two or more chlorides of Na, K and Li. Chlorides of Zn and Mg respectively function as suppliers of Zn and Mg ions, while chlorides of Na, K and Li serve as conductors or melting point lowering agents. The contents of the chlorides in the plating bath can be determined suitably in accordance with the Mg content to be obtained and, hence, are not restricted.

The plating temperature preferably ranges between about 350 and 500° C. Plating cannot be conducted satisfactorily at a bath temperature below about 350° C. because at such a low temperature the plating bath starts to solidify. Plating temperature exceeding about 500° C. also is not preferred because such a high temperature of the plating bath causes not only fuming from the bath but also excessive diffusion of Fe so as to increase the Fe content to a level exceeding about 25 wt %, resulting in degradation of the properties of the steel sheet.

The plating electric current density preferably ranges from about 20 to 350 A/dm$^2$. It is impossible to form a satisfactory plating layer when the current density is below about 20 A/dm$^2$. On the other hand, plating current density exceeding about 350 A/dm$^2$ requires an excessively high voltage. In addition, the bath temperature is undesirably raised by the heat generated by electrical resistance of the steel sheet, when such a large current density is adopted. When the plating is conducted under the above-described conditions, Fe is diffused from the steel sheet so that the mean value of the Fe content in the plating layer is controlled within the range between about 0.5 and 25 wt %. In addition, it is possible to obtain such a gradient of the Fe content that the Fe content is greatest at the interface between the plating layer and the steel sheet and is progressively reduced towards the surface of the plating layer opposite to the steel sheet so as to become zero at this surface.

A Zn-Mg alloy plated steel sheet according to the present invention will now be described.

Preferably, the plating alloy used in the invention has an Mg content ranging from about 1 to 35 wt %, preferably from about 5 to 35 wt %. Any Mg content below about 1 wt % cannot produce any appreciable effect in preventing corrosion so that the plating layer can provide only such a low level of corrosion resistance as could be attained by ordinary Zn plating layer. An appreciable corrosion prevention effect is produced when the Mg content exceeds about 1 wt %, particularly when the Mg content is about 5 wt % or greater. On the other hand, the corrosion prevention effect is saturated when the Mg content exceeds about 35 wt %. Addition of Mg in excess of about 35 wt % is not recommended not only from a view point of economy but also because addition of such large amount of Mg makes fragile the plating layer to increase cracking tendency of the plating layer resulting in an inferior resistance to corrosion.

One of the reasons of the superior corrosion resistance offered by a Zn-Mg alloy is considered to reside in the fact that Mg serves to suppress generation of ZnO which does not have any corrosion prevention effect and to promote generation of $Zn(OH)_2$ and $ZnCO_3$ which are effective in preventing corrosion.

The plating alloy used in this invention contains about 0.5 to 25 wt % of mean value of Fe. Fe present in the plating layer improves adhesion or affinity between the plating layer and the steel sheet. In order to attain an appreciable improvement in the plating adhesion, the mean Fe content should not be below about 0.5 wt %. Conversely, presence of mean value of Fe in excess of about 25 wt % makes the plating layer fragile, with the result that he plating adhesion is seriously impaired. Presence of Fe in the surface region of the plating layer promotes generation of red rust. It is therefore preferred that the plating layer does not substantially contain Fe in its surface region. Greater plating adhesion and greater corrosion resistance are obtained when the Fe content has such a thicknesswise gradient that it is greatest at the surface of the plating layer adjacent the steel sheet and progressively decreases towards the surface opposite to the steel sheet.

Preferably, the coating weight on the plated steel sheet of the present invention is about 10 to 60 g/m$^2$. Sufficiently large corrosion resistance cannot be obtained when the coating weight is less than about 10 g/m$^2$. In general, the greater the coating weight, the higher the corrosion resistance. The coating weight, however, should not exceed about 60 g/m$^2$ because such a large coating weight raises the cost of the product for the required corrosion resistance and impairs weldability and workability.

The steel sheet in accordance with the present invention itself possesses superior corrosion resistance characteristic. In order to attain a higher corrosion resistance, however, the above-mentioned plating layer may be coated with a chromate layer. Such a chromate layer protects the plated steel sheet from the corrosive environment so as to improve corrosion resistance. The amount of chromium in the chromate on the plating layer is preferably about 200 mg/m$^2$ or less. Although the corrosion resistance can be increased in accordance with an increase in the amount of the chromate used, any chromium amount exceeding about 200 mg/m$^2$ in the chromate is not preferred because the effect for improving the corrosion resistance is uneconomically saturated and because the color of the plating layer is undesirably changed into yellow. The chromate layer can be formed by any suitable known method such as application of a chromate solution or an electrolytic process.

In order to attain a still further improvement of corrosion resistance, the plated steel sheet of the present invention can have an organic film of a thickness not greater than about 2 μm formed on the chromate layer and containing not more than about 50 wt % of silica sol. This film of a thickness not greater than about 2 μm is generally porous so that it does not function as a shield layer against corrosive materials but is still effective in preventing corrosion because it retains corrosive materials. Obviously, a greater thickness of this organic film provides a higher resistance to corrosion but its weldability is undesirably impaired when the thickness of this layer exceeds about 2 μm.

Silica sol securely holds the corrosive products so as to contribute to prevention of corrosion. Presence of silica sol in excess of about 50 wt %, however, is not preferred because it impairs weldability of the steel sheet. The organic film can be formed by application by a roll coater followed by a hot-air drying, although other suitable methods can be employed.

The chromate layer and the organic coating film are not essential and are electively used in accordance with the uses of the product steel sheet.

EXAMPLES

A description will now be given of some Examples of the Zn-Mg alloy plated steel sheet of the present invention in comparison with some Comparison Examples. Samples of steel sheets were subjected to ordinary steps such as degreasing, pickling and drying in a non-oxidizing atmosphere. The samples of steel sheets were then pre-heated to the plating temperature and were subjected to Zn-Mg alloy plating conducted in different fused salt plating baths A to D shown below. Some of the thus-plated steel sheets were further subjected to chromate treatment, with or without subsequent application of organic coating material.

Plating Bath A

| | |
|---|---|
| $ZnCl_2$ | 63.00 mol % |
| $MgCl_2$ | 5.00 mol % |
| NaCl | 30.00 mol % |
| KCl | 2.00 mol % |
| Plating Bath B | |
| $ZnCl_2$ | 61.00 mol % |
| $MgCl_2$ | 9.00 mol % |
| NaCl | 26.00 mol % |
| KCl | 4.00 mol % |
| Plating Bath C | |
| $ZnCl_2$ | 60.40 mol % |
| $MgCl_2$ | 4.60 mol % |
| NaCl | 28.60 mol % |
| KCl | 1.80 mol % |
| LiCl | 4.60 mol % |

-continued

| | |
|---|---|
| Plating Bath D | |
| $ZnCl_2$ | 55.30 mol % |
| $MgCl_2$ | 16.80 mol % |
| NaCl | 26.20 mol % |
| KCl | 1.70 mol % |
| Plating Bath E | |
| $ZnCl_2$ | 66.35 mol % |
| $MgCl_2$ | 0.25 mol % |
| NaCl | 31.40 mol % |
| KCl | 2.00 mol % |

Chromate Treatment

A chromate liquid 4513H, produced by Nippon Parkerizing Kabushiki Kaisha, was applied by means of a reversible roll coater, followed by a 20-second drying at 110° C.

Application of Organic Coating Material

A coating solution was prepared by mixing epoxy urethane type organic resin and silica sol, and was applied by means of a reversible roll coater, followed by a 30-second drying at 150° C.

Evaluation of Plating Adhesion

The plated steel sheets were bent through 180° and tested by the adhesive tape test method. The plating adhesion was evaluated in terms of the amount of delamination of the plating material.

Criteria of Evaluation

◎: No delamination
○: Slight delamination
X: Heavy delamination

Evaluation of Corrosion Resistance

The samples were subjected to a salt spray test for measurement of time till generation of red rust.

The results of the evaluation of performance of the samples of plated steel sheets are shown in Table 1. As will be understood from this Table, the Zn-Mg alloy plated steel sheets produced in accordance with the present invention are superior both in plating adhesion and corrosion resistance.

TABLE 1

| Samples | Pre-heat temp. (°C.) | Planting bath type | Bath temp (°C.) | Current density (A/dm²) | Coating weight (g/m²) | Mg content (wt %) | Fe content of mean value (wt %) |
|---|---|---|---|---|---|---|---|
| Example 1 | 380 | A | 400 | 100 | 20 | 12 | 10 |
| Example 2 | 400 | B | 450 | 150 | 15 | 33 | 20 |
| Example 3 | 400 | C | 430 | 200 | 30 | 10 | 5 |
| Example 4 | 420 | B | 480 | 50 | 20 | 22 | 13 |
| Example 5 | 350 | C | 380 | 100 | 55 | 21 | 9 |
| Example 6 | 400 | A | 420 | 75 | 10 | 18 | 11 |
| Example 7 | 430 | B | 440 | 340 | 30 | 5 | 24 |
| Example 8 | 400 | A | 420 | 150 | 20 | 15 | 12 |
| Example 9 | 350 | B | 390 | 125 | 40 | 30 | 23 |
| Example 10 | 380 | C | 380 | 25 | 30 | 25 | 15 |
| Example 11 | 400 | C | 400 | 230 | 30 | 9 | 4 |
| Comp. Ex. 1 | 410 | A | 420 | 30 | 5 | 11 | 13 |
| Comp. Ex. 2 | 380 | E | 400 | 15 | 30 | 40 | 17 |
| Comp. Ex. 3 | 350 | D | 440 | 220 | 20 | 0.6 | 21 |
| Comp. Ex. 4 | 420 | A | 550 | 380 | 15 | 17 | 29 |
| Comp. Ex. 5 | Formed by vapour deposition | Formed by vapour deposition | Formed by vapour deposition | Formed by vapour deposition | 20 | 20 | 0 |

| Samples | Fe content at surface (wt %) | Chromate amount (Cr mg/m²) | Organic coat film: Amount (μm) | Organic coat film: Silica sol content (wt %) | Plating adhesion | Time till red-rusting (hr) |
|---|---|---|---|---|---|---|
| Example 1 | 0 | 0 | 0 | | ○ | 660 |

TABLE 1-continued

| | | | | | | |
|---|---|---|---|---|---|---|
| Example 2 | 0 | 0 | 0 | | O | 520 |
| Example 3 | 0 | 0 | 0 | | O | 760 |
| Example 4 | 0 | 0 | 0 | | O | 690 |
| Example 5 | 0 | 0 | 0 | | O | 860 |
| Example 6 | 0 | 0 | 0 | | O | 440 |
| Example 7 | 0 | 0 | 0 | | O | 740 |
| Example 8 | 0 | 30 | 0 | | O | 1020 |
| Example 9 | 0 | 180 | 0 | | O | 1180 |
| Example 10 | 0 | 60 | 0.5 | 40 | O | 1286 |
| Example 11 | 0 | 100 | 1.5 | 25 | O | 1510 |
| Comp. Ex. 1 | 0 | 0 | 0 | | O | 72 |
| Comp. Ex. 2 | 0 | 0 | 0 | | X | 112 |
| Comp. Ex. 3 | 0 | 0 | 0 | | | 36 |
| Comp. Ex. 4 | 5 | 0 | 0 | | X | 98 |
| Comp. Ex. 5 | 0 | 0 | 0 | 0 | X | 420 |

*Underlines indicate that conditions do not meet requirements set forth in Claim.

As will be understood from the foregoing description, the Zn-Mg alloy plated steel sheet produced by the method of the present invention exhibits superior plating adhesion, as well as high resistance to corrosion, by virtue of the presence of a sufficiently large amount of Mg and a moderate amount of Fe in the plating layer.

It is also to be understood that the Mg content in the plating layer is easily controllable since the electroplating is conducted in a bath of a fused salt. This plating method also enables the Fe to be diffused from the steel sheet to develop such a gradient of Fe content that the Fe content progressively decreases towards the surface of the plating layer opposite to the steel sheet, thereby offering remarkable improvement in the plating adhesion and corrosion resistance of the plated steel sheets as the products. A further improvement in the corrosion resistance is attainable by providing a chromate layer on the plating layer. A still further improvement is attainable by forming an organic coating layer containing silica sol on the chromate layer.

What is claimed is:

1. A method of producing a Zn-Mg alloy plated steel sheet superior both in plating adhesion and corrosion resistance, comprising the step of electroplating at least one surface of a steel sheet by using a plating bath of a fused salt at about 350 to 500° C. and containing a chloride of Zn, a chloride of Mg and one, two or more chlorides selected from the group consisting of Na, K and Li, with a plating current density ranging between about 20 and 350 A/dm$^2$.

2. The method defined in claim 1 wherein said electroplating step is controlled to produce a plating layer of about 10 to 60 g/m$^2$ and containing about 1–35 wt % of Mg, about 0.5–25 wt % of mean value of Fe and the balance substantially Zn and incidental inclusions.

3. The method defined in claim 2 wherein said electroplating step is controlled to produce a plating layer having an Fe content which is greatest at the sheet interface and progressively decreases toward the plating layer surface.

4. A Zn-Mg alloy plated steel sheet superior both in plating adhesion and corrosion resistance, comprising a steel sheet having a plating layer formed on at least one surface of said steel sheet in an amount of about 10 to 60 g/m$^2$, and by electroplating in a bath of a fused salt, said plating layer containing about 1 to 35 wt % of Mg, about 0.5 to 25 wt % of mean value of Fe and the balance substantially Zn and incidental inclusions.

5. A Zn-Mg alloy plated steel sheet according to claim 4, wherein the Fe content in said plating layer is greatest at the interface between said plating layer and said steel sheet and progressively decreases towards the surface of said plating layer opposite to said steel sheet, and at said surface the Fe content is substantially zero.

6. A Zn-Mg alloy plated steel sheet according to either one of claims 4 or 5, further comprising a chromate layer formed on said plating layer and wherein the amount of deposition of chromium is up to but not greater than about 200 mg/m$^2$.

7. A Zn-Mg alloy plated steel sheet according to claim 6, further comprising an organic coating film formed on said chromate treatment layer, said organic coating layer having a thickness which is up to but not greater than about 2 μm, and said coating layer containing up to but not more than about 50 wt % of silica sol.

* * * * *